US005784791A

United States Patent [19]

Nakamura

[11] Patent Number: 5,784,791

[45] Date of Patent: Jul. 28, 1998

[54] ADJUSTABLE COMPASS

[76] Inventor: Rodney S. Nakamura, 1047 Hooli Pl., Pearl City, Hi. 96782

[21] Appl. No.: 648,615

[22] Filed: May 16, 1996

[51] Int. Cl.[6] ..... B43L 9/04

[52] U.S. Cl. ..... 33/27.03; 33/27.031

[58] Field of Search ..... 33/27.01, 27.02, 33/27.03, 27.031, 27.032, 27.033

[56] References Cited

U.S. PATENT DOCUMENTS

| | | | |
|---|---|---|---|
| 487,892 | 12/1892 | Robinson . | |
| 510,139 | 12/1893 | Houck | 33/27.031 |
| 517,696 | 4/1894 | Hunter . | |
| 677,339 | 7/1901 | Comstock . | |
| 692,215 | 1/1902 | Starrett | 33/27.031 |
| 720,507 | 2/1903 | Van Horn . | |
| 801,789 | 10/1905 | Heck | 33/27.031 |
| 807,660 | 12/1905 | Clutter | 33/27.02 |
| 1,219,141 | 3/1917 | Nelson . | |
| 1,298,585 | 3/1919 | Sheppard | 33/27.03 |
| 1,619,750 | 3/1927 | Nelson | 33/27.031 |
| 1,852,485 | 4/1932 | Sidon . | |
| 2,134,069 | 10/1938 | Zimmerman | 33/27.03 |
| 2,551,747 | 5/1951 | Ille | 33/27.03 |
| 2,824,377 | 2/1958 | Asperger | 33/27.032 |
| 4,051,599 | 10/1977 | Sinkovec . | |
| 4,616,418 | 10/1986 | Wade, III . | |
| 5,235,754 | 8/1993 | Sirois . | |

FOREIGN PATENT DOCUMENTS

| | | | |
|---|---|---|---|
| 151271 | 10/1952 | Australia | 33/27.03 |
| 106129 | 10/1899 | German Dem. Rep. | 33/27.03 |
| 27311 | 7/1909 | United Kingdom | 33/27.031 |

*Primary Examiner*—Thomas B. Will

*Attorney, Agent, or Firm*—Martin E. Hsia

[57] ABSTRACT

A compass having a pivot portion with an open faced clamp and a utensil portion with an open faced clamp, so that the portions can be clamped onto intermediate bars of varying shapes and sizes. The utensil holder is also angularly adjustable with respect to the pivot point so small circles can be drawn. Only the pivot portion and the utensil portion need to be transported because suitable intermediate bars would probably be available at the location where work is to be performed.

13 Claims, 8 Drawing Sheets

ADJUSTABLE COMPASS

TECHNICAL FIELD

This invention relates to an adjustable compass for use in making circles having a wide range of sizes using any convenient material for an intermediate bar.

Compasses are well known as instruments for marking or cutting circles. Traditional compasses usually comprise a pivot arm (with a pivot end and a joint end) and a utensil arm (with a utensil end and a joint end). The joint ends are usually angularly adjustably joined to each other, with a pivot point at the pivot end of the pivot arm, and a utensil holder (which can hold a marking instrument, a cutting instrument, or some other utensil) at the utensil end of the utensil arm. However, the radii of the circles traditional compasses can scribe is limited by the combined lengths of their arms. Thus, a traditional compass capable of drawing large circles must inherently be large enough that each of its arms is at least half the radius of the largest circle to be drawn.

Beam compasses, or trammels, are also known, in which a pivot point and a utensil holder are independently movably mounted along a rigid intermediate beam (or bar). However, the beam must be approximately as long as the radius of the largest circle to be drawn. This can make beam compasses capable of drawing large circles even more inconvenient to transport than traditional compasses capable of drawing circles of the same size, because the intermediate beam must be approximately equal to the full radius of such circles, while the arms of traditional compasses need to be only approximately half the radius of such circles (and the arms of a traditional compass can be folded against each other for transportation and storage).

It is therefore inconvenient to transport a compass capable of drawing large circles because the arms (or beam) of the compass must be large as well.

BACKGROUND ART

U.S. Pat. No. 2,824,377 to Asperger discloses a head unit for a trammel which is slidably adjustable upon a blade or rule-like beam and which has detachably associated attachments that are readable with calibrations on the blade and are also constructed for marking or measuring distances between two points.

U.S. Pat. No. 5,235,754 to Sirois discloses a beam compass having a hollow beam, two implement securing units and a slot communicating with the interior of the beam. FIG. 4 of Sirois discloses the use of offset holes so that the writing implement extends at an angle from the vertical to enhance the stability of the compass.

U.S. Pat. No. 487,892 to Robinson discloses a beam compass in which minor adjustments of the point of a pencil can be effected by the operation of an adjusting screw.

U.S. Pat. No. 517,696 to Hunter discloses a beam compass that can serve as a ruler, compass and square.

U.S. Pat. No. 677,339 to Comstock discloses a center punch and gauge that holds the punch in proper position for use and also indicates the exact distance of the punch from any given point.

U.S. Pat. No. 1,852,485 to Sidon discloses a beam compass and measuring device that provides a pressure plate to prevent rocking movement of a sliding member on the beam.

U.S. Pat. No. 720,507 to Van Horn discloses a trammel in which a tape is carried by the marking device.

U.S. Pat. No. 1,219,141 to Nelson discloses a trammel having a horizontally disposed box-like extension into which a block is slidably fitted and to which the trammel is detachably connected.

U.S. Pat. No. 4,051,599 issued to Sinkovec discloses a beam compass having a triangular cross-section scale.

U.S. Pat. No. 4,616,418 to Wade III discloses a beam compass having changeable parts in which the marker carrier can receive a large marker, or a chuck can be inserted for receiving smaller diameter markers.

Most beam compasses are adapted to use only bars with a specific cross-sectional size or shape. Also, most beam compasses are limited to using intermediate bars with a maximum cross-section that can be received in the heads carrying the pivot point and utensil portions. Further, the pivot and utensil portions on such devices must extend lengthwise somewhat along the bar for stability. However, this makes it virtually impossible to make circles having a very small diameter using the same compass as is used to make large circles.

It is therefore an object of the present invention to provide a compass that can be adapted to use any convenient rigid or semi-rigid elongated member in order to draw circles.

It is a further object of this invention to provide such a compass that is not limited by the maximum cross-sectional dimension of an intermediate beam (or bar).

It is a still further object of the present invention to provide such a compass that can accept a variety of utensils having a wide range of diameters without the necessity of inserting a chuck or other diameter adjusting device.

It is a still further object of the present invention to provide such a compass that is economical and easy to manufacture and can be made from readily available stock parts.

DISCLOSURE OF INVENTION

The compass of this invention comprises:

a pivot member;

an open-faced adjustable pivot clamp having jaws movable over a range of separation distances mounted on the pivot member;

a pivot point attached to the bottom portion of the pivot member;

an open-faced adjustable utensil clamp having jaws movable over a range of separation distances; and a utensil holder attached to the utensil clamp.

The pivot clamp is attachable to a pivot portion of an intermediate bar and the utensil clamp is attachable to a utensil portion of the intermediate bar to form a compass. The clamps each have jaws that are movable so that the distance between the jaws defines a separation distance, and the separation distance preferably can be varied over a range, optimally from zero (in which the jaws touch each other) to a maximum separation distance that is approximately the height of the pivot member.

Because the clamps are open-faced (that is, there is a gap between the contacting portions of the jaws through which items to be clamped can be introduced at a wide variety of angles, as opposed to closed face clamps, in which items can only be introduced through the ends of the clamp), intermediate bars having widths greater than the maximum width of the jaws of the clamps can be used, as long as some portion of the intermediate bars has a cross section smaller than the maximum separation distance, so that the jaws can clamp that portion. Optimally, one of the jaws of the clamps is invertable and is provided with wings that, in one orientation, extend towards the opposite jaw and extend diagonally outwards from the body of the clamp. The opposite jaw optimally can fit in between the wings, so that the opposite jaw can be received between the wings and so that the space defined by the diagonally outwardly extending wings cooperates with the opposite jaw to clamp intermediate bars with very small diameters. Optionally, a lip can be provided adjacent to the body of the clamp to prevent the intermediate bar from being forced into contact with the body of the clamp. This optimal configuration allows an open faced clamp to function like a closed face clamp, while still remaining open faced.

It is preferred that the utensil holder be angularly adjustable with respect to the utensil clamp and that the utensil holder comprise a sleeve with an adjustment aperture. An adjustment member would adjustably extend through the adjustment aperture into the sleeve and a utensil smaller than the sleeve's diameter can be retained in the utensil sleeve by compressing the utensil between the sleeve and the adjustment member.

Other objects, features and advantages of the present invention will become more fully apparent from the following detailed description of the presently preferred embodiment for carrying out the invention, the claims and the accompanying drawings.

BEST MODE FOR CARRYING OUT INVENTION

The best mode presently contemplated for carrying out the present invention is the preferred embodiment illustrated by way of example in FIGS. 1–10.

Figure 1:
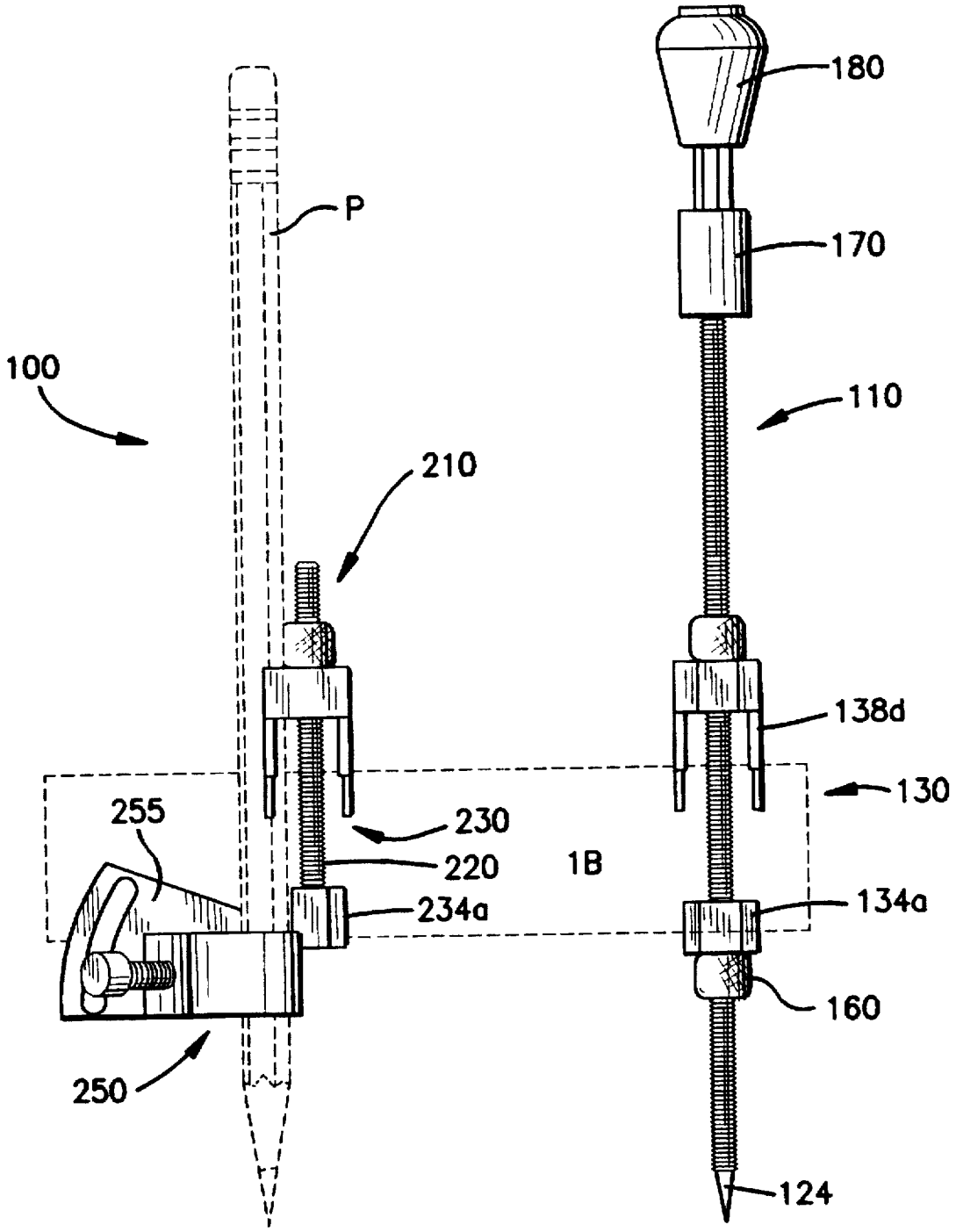
FIG. 1 shows a front elevational view of a presently preferred embodiment of the present invention with the dotted line showing environmental structure and forming no part of the invention.

Referring to FIG. 1, the device 100 comprises a pivot portion 110 and a utensil portion 210.

The pivot portion 110 comprises a pivot member 120, preferably a threaded rod. Preferably an open faced pivot clamp 130 is mounted on the pivot member 120 and retained in place by a pivot retainer 160 that is threadingly engaged with the pivot member 120.

Preferably a pivot point 124 is provided at the bottom of the pivot member 120, and is preferably integrally formed with the pivot member 120.

Preferably a spinner member 170 is rotatably mounted on the end of the pivot member 120 opposite the pivot point 124. A foot member 180 is preferably removably mounted on the spinner member 170. The foot member 180 is preferably made of rubber, plastic, or a similar material, and preferably can be rotatably mounted over the pivot point 124, as described below.

The utensil portion 210 preferably comprises a utensil member 220, preferably a threaded rod, an open faced adjustable utensil clamp 230 and a utensil holder 250 angularly adjustably attached to the utensil clamp 230.

Figure 2:
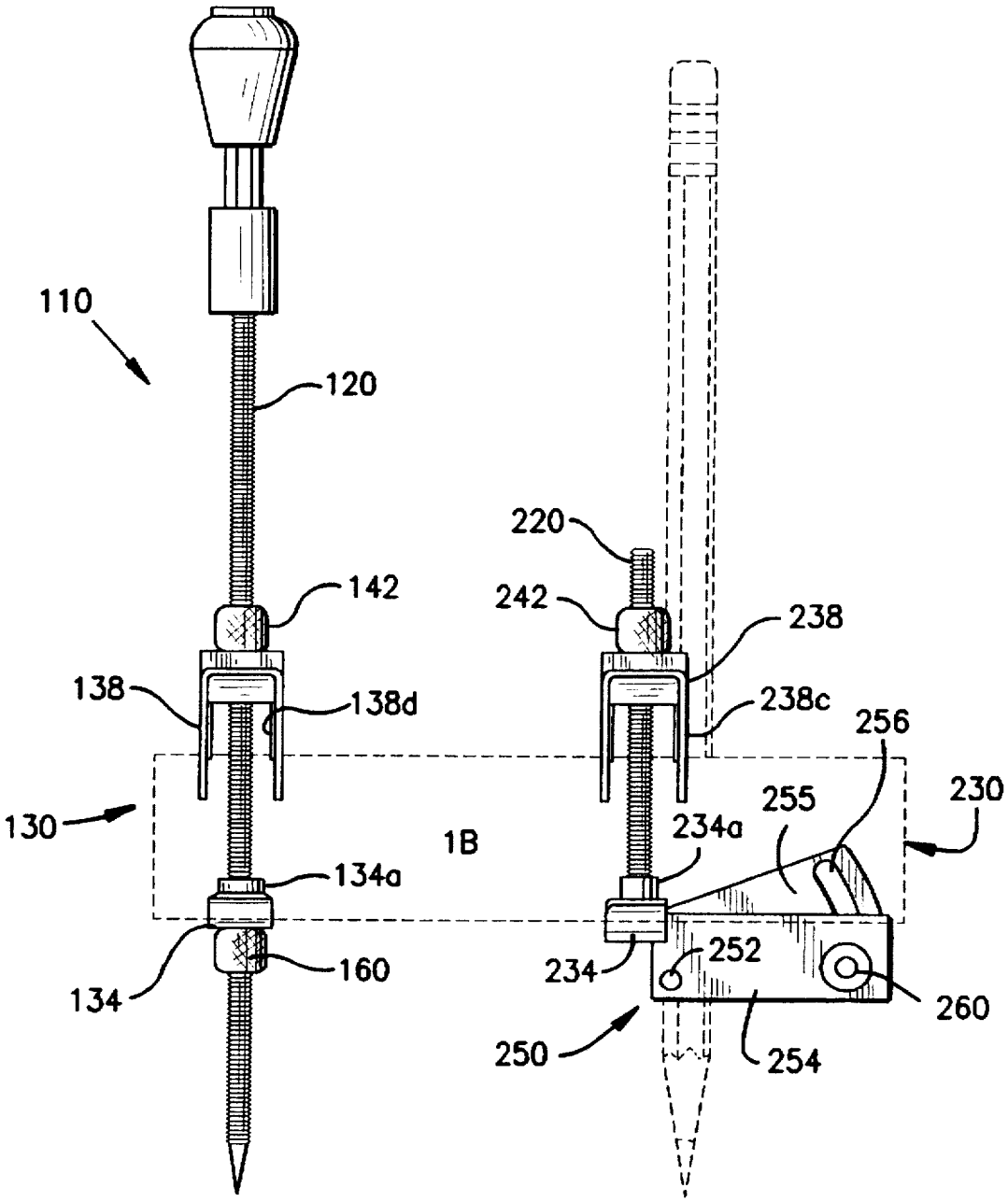
FIG. 2 is a rear elevational view of the embodiment of FIG. 1.

As can be seen in FIG. 2, the open faced adjustable pivot clamp 130 comprises a lower pivot jaw 134 that abuts against a lower pivot jaw retainer 160 that is movably mounted on the pivot member 120, and an upper pivot jaw 138 that abuts against an upper pivot jaw retainer 142 that is movably mounted on the pivot member 120. The upper pivot jaw 138 and the lower pivot jaw 134 are both movable along the pivot member 120, so that the separation distance between them can be adjusted, preferably over a wide range. Optimally, the separation distance can be varied from zero to the height of the pivot member.

In similar fashion, the utensil clamp 230 comprises a lower utensil jaw 234 that is mounted on utensil member 220. An upper utensil jaw 238 is mounted on the utensil member 220 and retained on the member 220 by a utensil retainer 242 that is threadingly engaged with the utensil member 220.

The utensil holder 250 preferably comprises a holder plate 254 affixed to (and preferably integrally formed with) the lower utensil jaw 234, an angular adjustment plate 255 having an adjustment arc 256 formed therein rotatably attached to the holder plate 254 by an angular movement screw 252, and an angular adjustment knob 260 extending through the adjustment arc 256 for securing the angular adjustment plate 255 in a desired angular position with respect to the holder plate 254. A utensil sleeve 270 (see FIG. 3) is preferably mounted on the angular adjustment plate 255.

Figure 3:
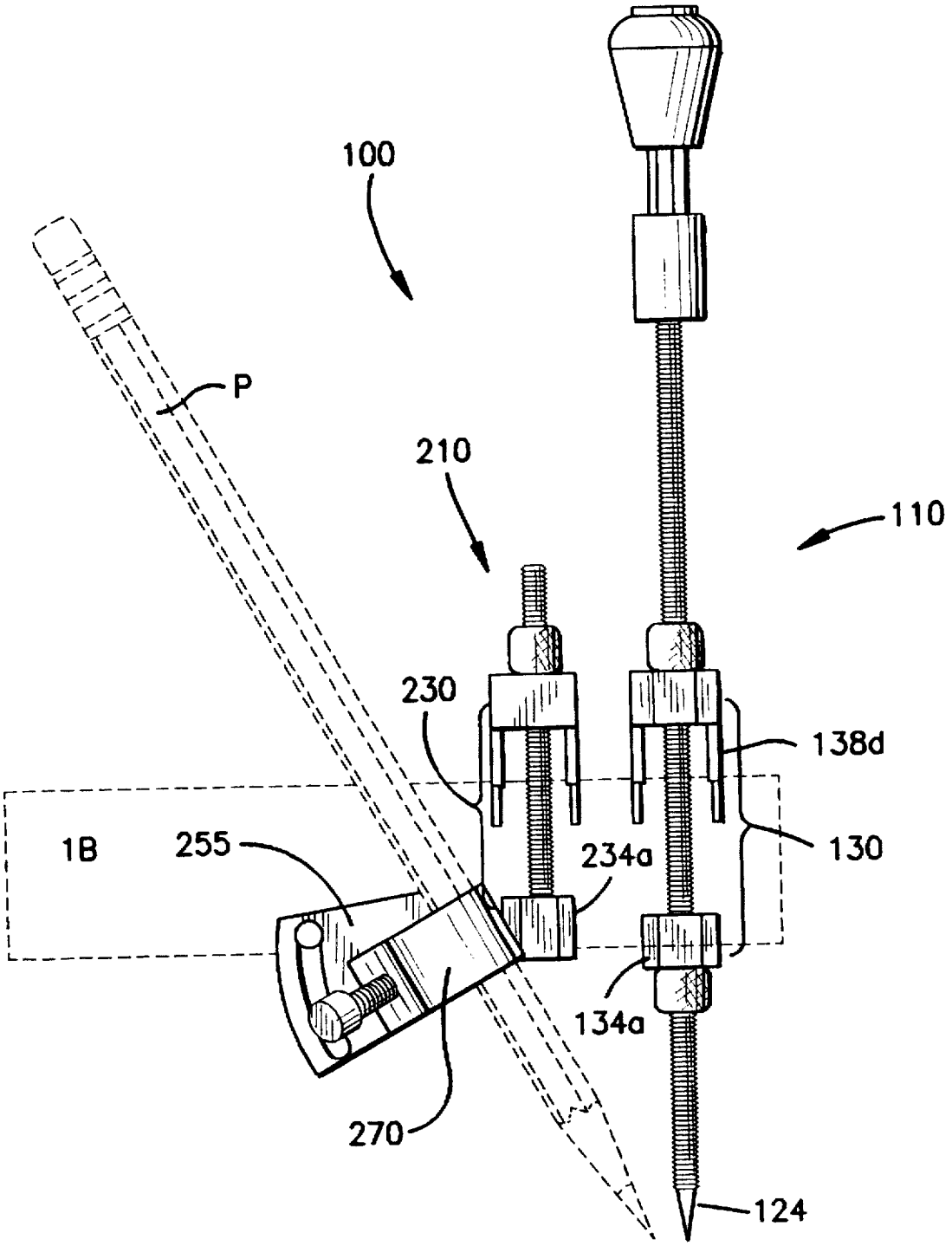
FIG. 3 is a front elevational view of the embodiment of FIG. 1 showing angular adjustment of the utensil holder to allow the device to form very small circles.

Referring to FIG. 3, shown is the embodiment of FIG. 1 with the pivot portion and the utensil portion clampingly engaged to adjacent portions of an intermediate bar IB. The angular adjustment plate 255 and the utensil sleeve 270 thereon have been angularly adjusted so that the pencil P is positioned at an angle with respect to the pivot member 120, thus bringing the point of the pencil P and the pivot point 124 into close proximity. In this configuration, the device 100 can be used to draw very small circles.

Providing angular adjustability between the utensil sleeve 270 and the utensil clamp 230 also is important if an irregularly shaped intermediate bar (such as a fallen branch) is used. If such an irregularly shaped intermediate bar causes the utensil sleeve 270 to be at an angle with respect to the pivot member 120, the utensil sleeve 270 can be angularly adjusted to be approximately parallel to the pivot member 120 to compensate, if desired.

Of course, angular adjustability can similarly be provided between the utensil holder and the arm on which it is mounted in a traditional compass in order to gain these same advantages. However, the inventor is unaware of any traditional compass that provides such angular adjustability.

Figure 4:
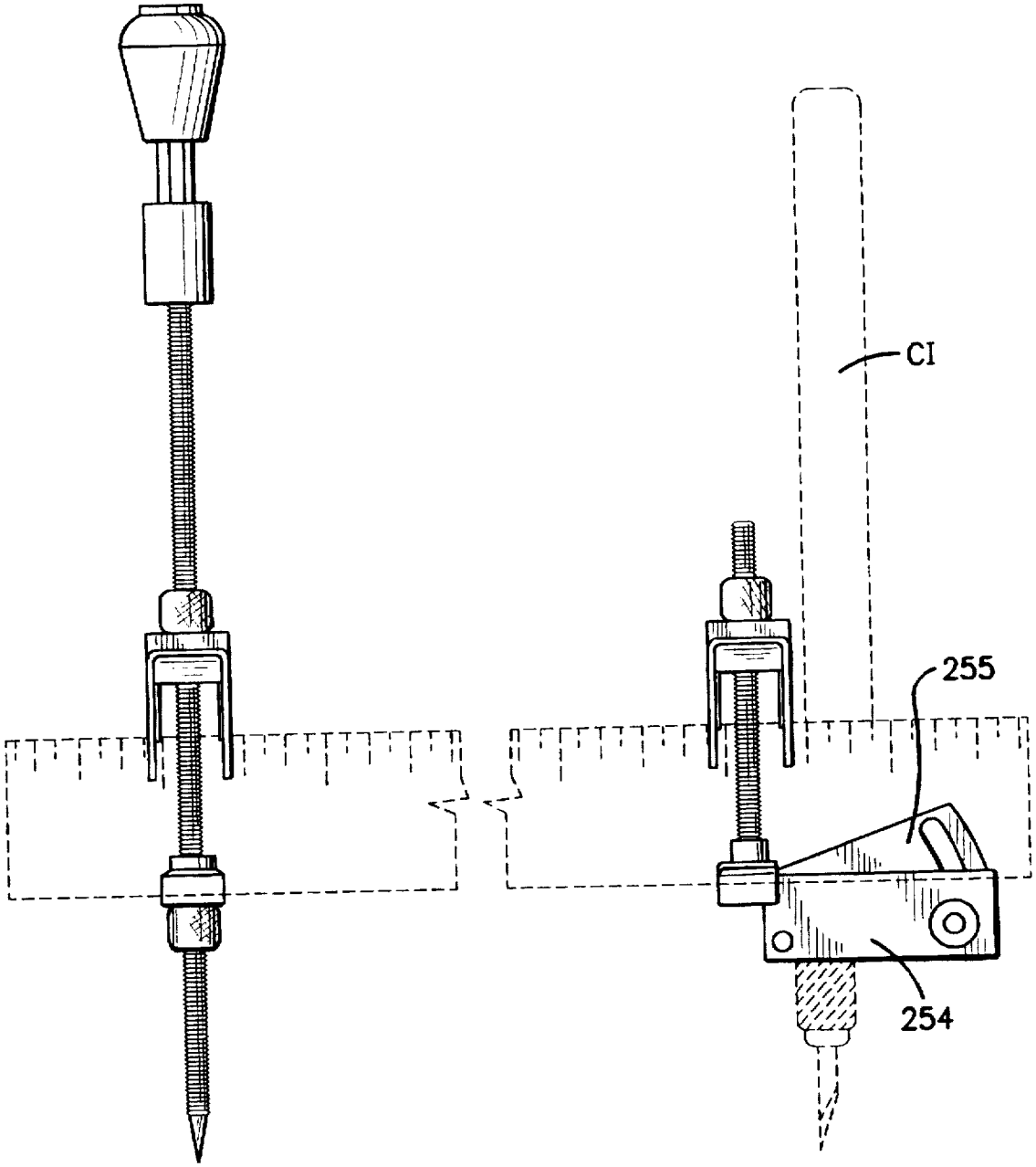
FIG. 4 is a rear elevational view of the embodiment of FIG. 1 showing how the device can be used in connection with an intermediate bar (such as a ruler) of any desired length in order to scribe a circle using a cutting implement, the dotted line showing environmental structure and forming no part of the invention.

Referring to FIG. 4, shown is a rear view of the embodiment of FIG. 1 attached at distal spaced apart portions of an intermediate bar IB in which a cutting implement CI is held in the utensil sleeve 270 (not shown) so that the device can be used to cut large circles.

Figure 5:
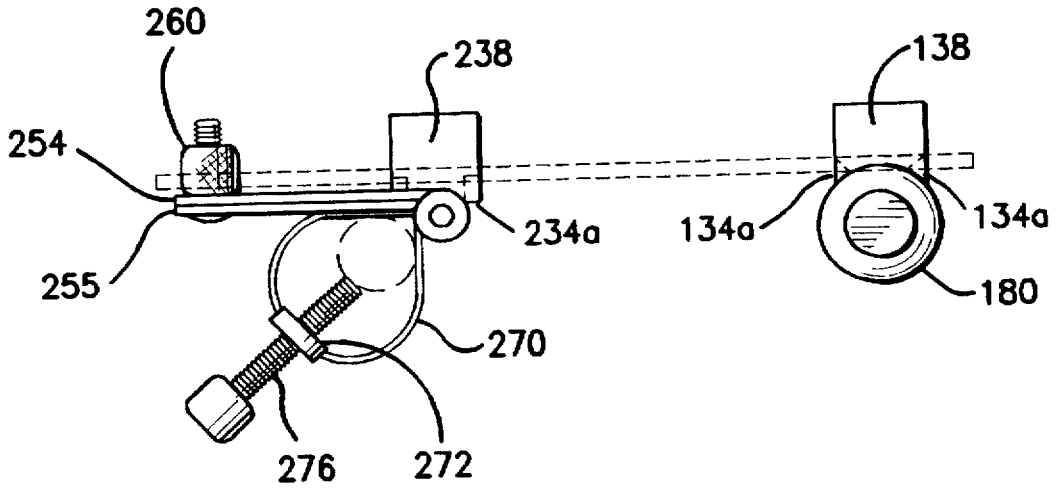
FIG. 5 is a top plan view of the embodiment of FIG. 1.

Referring to FIG. 5, shown is a top plan view of the embodiment of FIG. 1. As can be seen, the utensil sleeve 270 is preferably provided with a threaded adjustment aperture 272 and an adjustment member 276, preferably a threaded bolt, extends through the adjustment aperture into the interior of the adjustment sleeve 270. Thus, the utensil holder 250 can hold any utensil having a diameter smaller than the sleeve diameter by compressing the utensil between the sleeve 270 and the adjustment member 276.

Figure 6:
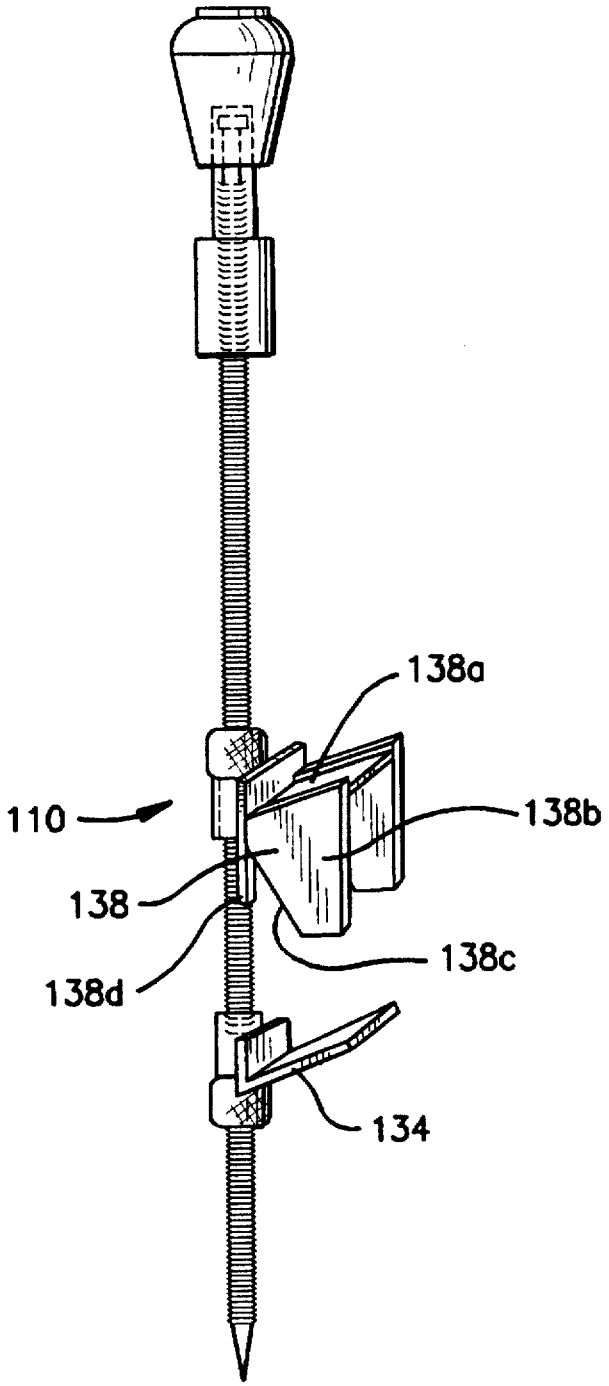
FIG. 6 is a perspective view from the right of the pivot member, pivot clamp, and pivot point of the embodiment of FIG. 1.
Figure 7:
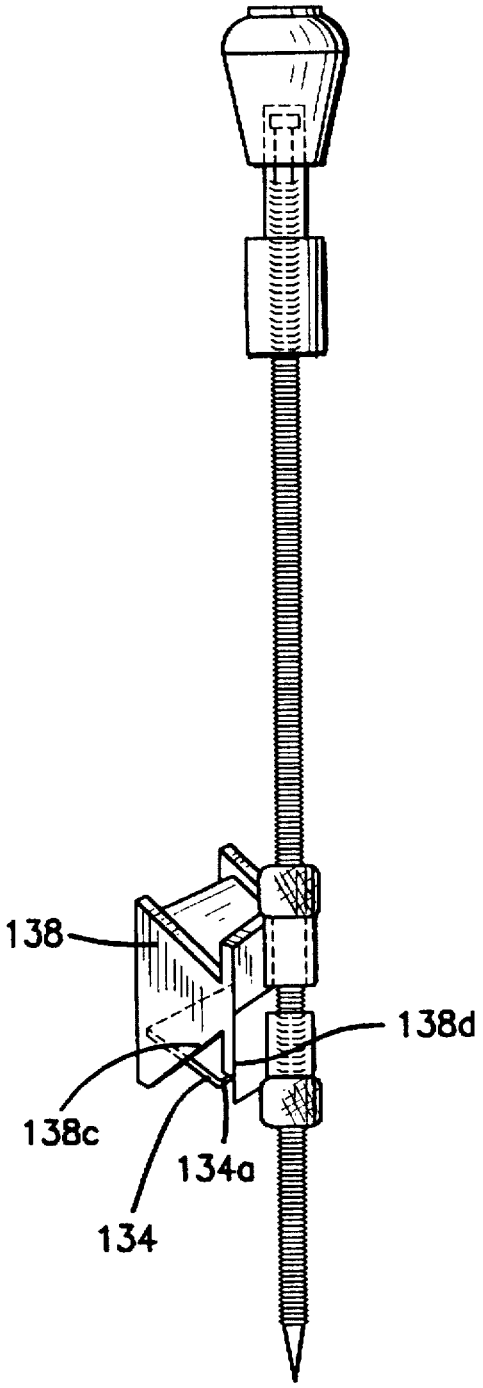
FIG. 7 is a perspective view from the left of the pivot member, pivot clamp, and pivot point of the embodiment of FIG. 1, showing the use of an intermediate member of very small cross section.

Referring to FIG. 6, shown is a perspective elevational view from the right of the pivot portion 110 of FIG. 1 showing the preferred shapes of the lower pivot jaw 134 and the upper pivot jaw 138. As can be seen, the lower pivot jaw 134 preferably has the shape of an extruded "7" (with notches cut out, as shown in FIG. 7). The top portion 138*a* of upper pivot jaw 138 also has the shape of an extruded "7", but two additional clamping wings 138*b* extend vertically downwardly (in the illustrated orientation) from the top portion 138*a*, with the portion extending outwardly from the pivot member 120 forming a diagonal edge 138*c*. Preferably, the two vertically extending clamping wings 138*b* are sufficiently spaced apart that the lower pivot jaw 134 can pass between them. Thus, the diagonal edges 138*c*, 238*c* cooperate with the lower jaws 134, 234 in a manner similar to guillotine blades. Optionally, a retaining lip 138*d* projects vertically from the inner portions of the diagonal edges 138*c* so that items clamped by the upper pivot jaw 138 are retained in the pivot clamp 130, rather than being forced inwardly until they abut against the pivot member 120. A retaining lip also can optionally be provided for the upper utensil jaw 238.

FIG. 7 similarly shows the shapes of the lower pivot jaw 134 and the upper pivot jaw 138, and also shows how the preferred configuration depicted in FIG. 6 allows the upper pivot jaw 138 and the lower pivot jaw 134 to cooperate to grasp an elongated intermediate bar of any cross sectional dimension, no matter how small. As can be seen, even the smallest diameter intermediate bar will be captured between the diagonal edge 138*c* and the lower pivot jaw 134, while the retaining lip 138*d* prevents the intermediate bar from slipping out of the clamp 130 and from abutting against the pivot member 120. Thus, for example, if the only suitable intermediate bar is a thin metal rod, the device can still be used. Preferably the retaining lip 138*d* is shaped like a post and fits inside a notch 134*a* formed in the lower jaw 134 so that the post 138*d* does not prevent the innermost portion of the upper jaw 138 from abutting against the innermost portion of the lower jaw 134.

The lower utensil jaw 234 and upper utensil jaw 238 preferably have the same configuration as the lower pivot jaw 134 and upper pivot jaw 138 to function in the same manner.

Figure 8:
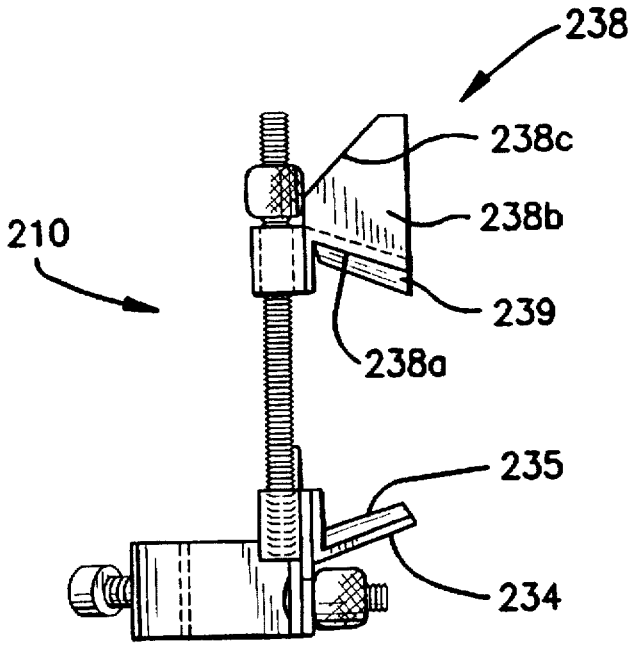
FIG. 8 is a side elevational view from the right of the utensil clamp and utensil holder of the embodiment of FIG. 1 with the upper jaw inverted for more clamping area and with a retaining lip omitted.

Referring to FIG. 8, shown is a side elevational view from the right of the utensil portion 210 of the embodiment of FIG. 1 showing the shape of the lower utensil jaw 234 and the upper utensil jaw 238, where the upper utensil jaw 238 has been inverted (mounted upside down) to provide an open faced clamp with a greater clamping surface. The optional retaining lip (corresponding to 138*d* of FIGS. 6 and 7) also has been omitted. In this arrangement, the upper (now lower) portion of the utensil jaw 238 cooperates with the lower utensil jaw 234 to clampingly engage an intermediate bar. This arrangement might be preferred where the intermediate bar is of such a material that a larger clamping surface is desired than the two diagonal edges 238*c* of the upper utensil jaw 238. Indeed, cushions 235, 239 can optionally be provided on the upper (now lower) portion 238*a* and the lower jaw 234 so that the clamping forces applied by the upper utensil jaw 234 and the lower utensil jaw 238 do not damage the surface of the intermediate bar. In the arrangement of FIG. 8, the upper utensil jaw wings 238*b* merely project upwardly and do not contribute to the clamping function of the utensil portion 210. However, if needed or desired, the upper utensil jaw 238 can be returned to its normal orientation shown in FIGS. 6 and 7.

Of course, the upper pivot jaw 138 similarly can be inverted to obtain the same advantages, and the upper pivot jaw 138 and lower pivot jaw 134 also can be similarly provided with cushions.

This ability to invert the upper jaws 138, 238 allows the open faced clamps 130, 230 to attain the advantages of close faced clamps when the diagonal edges 138*c*, 238*c* meet the lower jaws 134, 234, while structurally and functionally remaining open faced clamps.

Figure 9:
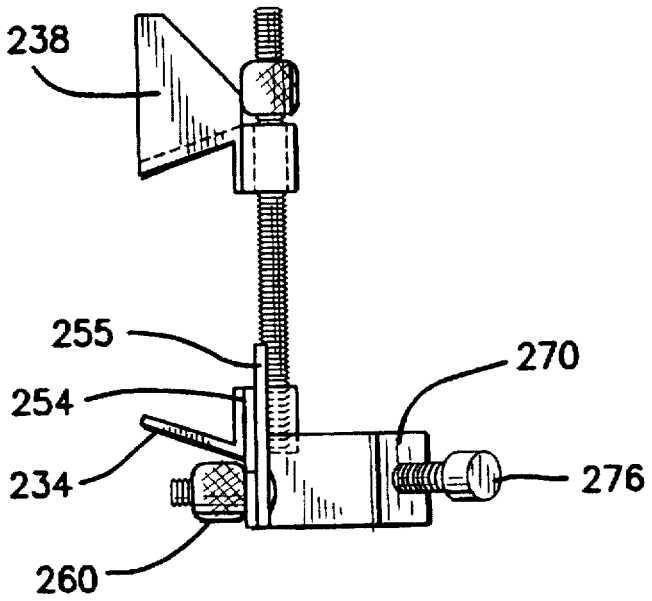
FIG. 9 is a side elevational view from the left of the utensil clamp and utensil holder of the embodiment of FIG. 8.

Referring to FIG. 9, shown is a side elevational view from the left of the utensil portion 210 of the embodiment of FIG. 1 to depict the relationship between the utensil sleeve 270, the holder plate 254, the angular adjustment plate 255, the angular adjustment knob 260 and the adjustment member 276.

Figure 10:
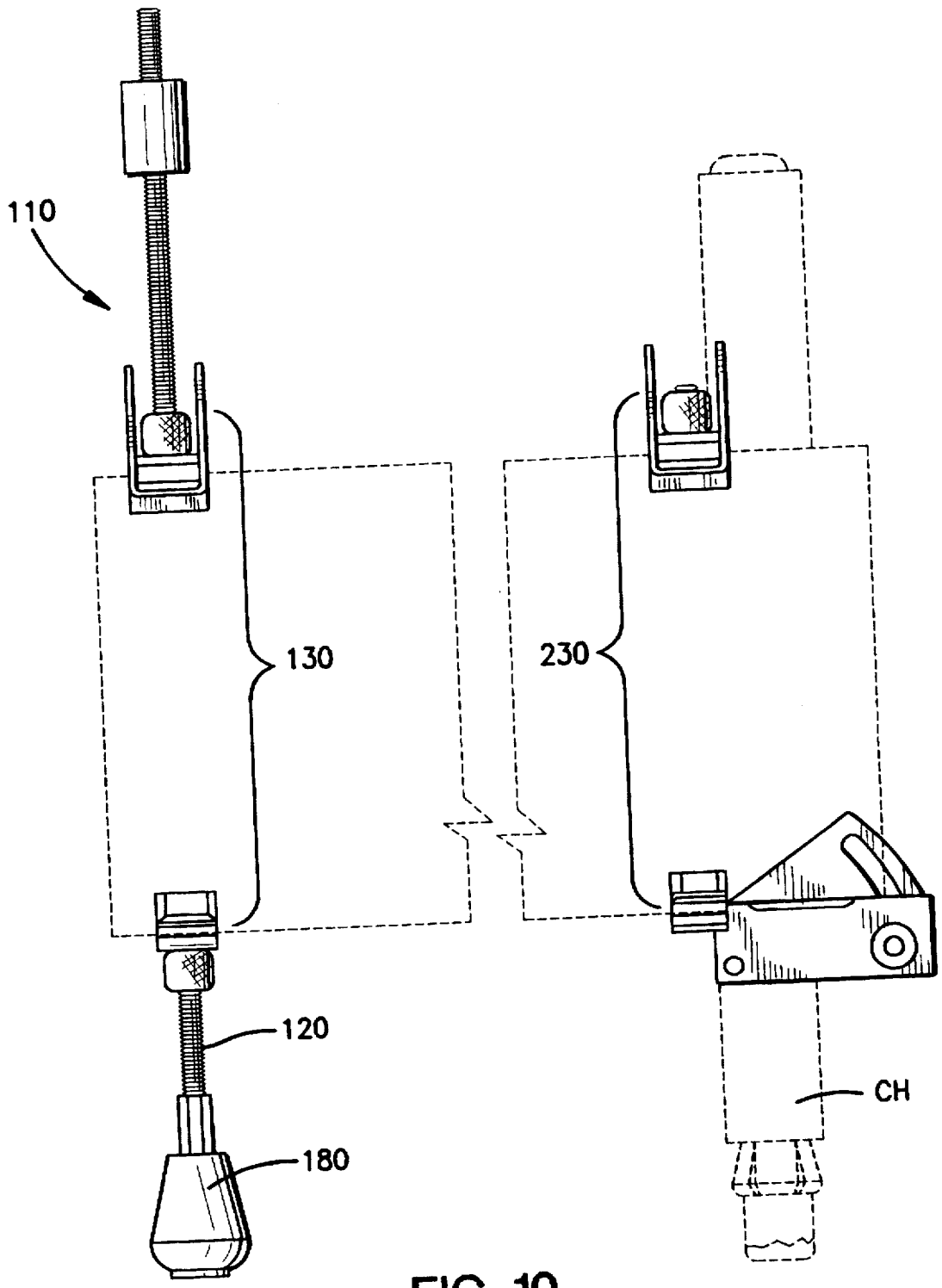
FIG. 10 is a rear elevational view of the embodiment of FIG. 1 with the upper jaw inverted and with a rubber foot covering the pivot point showing the use of an intermediate member of substantial width in order to make circles with chalk, the dotted line showing environmental structure and forming no part of the invention.

Referring to FIG. 10, the rubber foot 180 is preferably threadably and rotatably mountable on the pivot member 120 over the pivot point 124 (not shown) so that the pivot portion 110 can be used on surfaces where a sharp pivot point would be unacceptable, such as a blackboard. FIG. 10 also shows that the pivot clamp 130 and the utensil clamp 230 can be expanded to accommodate an intermediate bar of substantial width. The utensil holder is shown holding a chalk holder CH that is itself holding a piece of chalk.

As illustrated in FIG. 1, in the use of the presently preferred embodiment, a utensil such as a pencil P can be held in the utensil holder 250 and then the utensil clamp 230 can be clamped onto a utensil portion of an intermediate bar IB, while the pivot clamp 130 can be clamped on to a distal pivot portion of the intermediate bar. The intermediate bar can be any convenient rigid or semi rigid member to which the pivot clamp 130 and the utensil clamp 230 can be attached. Such a member can be found at the place where the compass is to be used, and need not be transported to that place with the pivot portion 110 or the utensil portion 210. For example, if it is desired to draw large circles in a forest, a fallen branch might serve as a suitable intermediate bar.

The radius of the circle to be drawn can be varied by varying the distance between the pivot portion 110 and the utensil portion 210 along the intermediate bar IB. After the pivot portion 110 and the utensil portion 210 have been properly positioned on the intermediate bar IB, the user can grasp the rubber foot 180 which is mounted on the rotatably mounted spinner member 170 and draw a circle of the desired radius.

As shown in FIG. 3, if the user desires to draw a smaller circle, the pivot portion 110 can be placed to abut against the utensil portion 210 so that the pivot member 120 and the pencil P are in close proximity, and the utensil sleeve 270 can be angularly adjusted with respect to the pivot member 120 to bring the point of pencil P as close to the pivot point 124 as desired.

As can best be seen by FIG. 5, the device can accommodate any utensil that can fit inside the utensil sleeve 270 because the utensil can be retained in the utensil sleeve 270 by compressing the utensil between the utensil sleeve 270 and the adjustment member 276. Indeed, instead of a closed utensil sleeve 270, an open faced clamp similar to the pivot clamp 130 or utensil clamp 230 can be substituted, although not presently preferred.

As can be seen from FIG. 6, because the pivot clamp 130 is open faced, the pivot clamp 130 can clamp onto intermediate bars with irregular cross section (that may even exceed the maximum width of the clamp) as long as a portion of that cross section can be grasped between the lower pivot jaw 134 and the upper pivot jaw 138. Thus, intermediate bars of irregular shape can readily be used with this device. Of course, the utensil clamp 230 can do the same.

As can be seen from FIG. 10, the pivot jaw 130 and utensil jaws 230 can be expanded considerably and therefore, the device can be used with intermediate bars that have a great range of widths as well.

The compass of the present invention can be made from any suitable material, such as metal, plastic or wood, but the type of material used is not critical.

While the present invention has been disclosed in connection with the presently preferred embodiment described herein, it should be understood that there may be other embodiments which fall within the spirit and scope of the invention, as defined by the claims. Accordingly, no limitations are to be inferred or implied in the scope of the invention, except as specifically and explicitly set forth in the attached claims.

INDUSTRIAL APPLICABILITY

This invention is applicable wherever it is desired to transport a compact instrument for accurately inscribing circles of widely varying radii using utensils. The device can use intermediate bars of irregular or large cross section and therefore the user can avoid the need to transport long intermediate bars, relying instead on finding appropriate intermediate bars at the workplace. For example, this invention can be used in instructional settings, because students and teachers would normally have access to rulers or yardsticks in such settings, so that large compasses would become unnecessary. Similarly, artists, crafters, engineers, architects designers and others would be expected to have easy access to elongated members at their workplace that could readily serve as intermediate bars for this invention.

What is claimed is:

1. A device, comprising:

a pivot member having a bottom portion;

an open faced adjustable pivot clamp having laws movable over a range of separation distances mounted on said pivot member;

a pivot point attached to said bottom portion of said pivot member;

an open faced adjustable utensil clamp having jaws movable over a range of separation distances;

a utensil holder attached to said utensil clamp;

whereby said pivot clamp is attachable to a pivot portion of an intermediate bar and said utensil clamp is attachable to a utensil portion of said intermediate bar to form a compass;

wherein said jaws of said pivot clamp are mounted on and threadingly engaged with a pivot clamp threaded rod, whereby said jaws of said pivot clamp can be adjusted to clampingly engage said pivot portion of said intermediate bar.

2. A device according to claim 1, wherein said pivot member and said pivot point are integrally formed.

3. A device according to claim 1, wherein said pivot member and said pivot point are formed from a material selected from the group consisting of metal, plastic and wood.

4. A device, according to claim 1, wherein said utensil holder comprises:

a utensil sleeve with a sleeve diameter having an adjustment aperture; and an adjustment member adjustably extending through said adjustment aperture into said sleeve;

whereby said utensil holder can retain any utensil smaller than said sleeve diameter by compressing said utensil between said sleeve and said adjustment member.

5. A device, according to claim 4, wherein said adjustment aperture is threaded and said adjustment member is a bolt threadingly engaged in said adjustment aperture.

6. A device according to claim 1, wherein said utensil holder is angularly adjustable with respect to said utensil clamp, whereby a utensil retained in said utensil holder can be angularly adjusted with respect to said utensil clamp.

7. A device according to claim 6, further comprising an angular adjustment knob attached to said utensil holder for retaining said utensil holder at a selected angle with respect to said utensil clamp.

8. A device, according to claim 1, further comprising a spinner member rotatably mounted on a top portion of said pivot member.

9. A device, according to claim 1, wherein said pivot member is a rod.

10. A device according to claim 1, further comprising:

a detachable foot adapted to be retained on said pivot point.

11. A device according to claim 10, wherein said foot comprises rubber.

12. A device comprising:

a pivot rod having a top portion and a bottom portion;

an open faced adjustable pivot clamp having jaws movable over a range of separation distances mounted on said pivot rod;

a spinner rotatably mounted on said top portion of said pivot member;

a pivot point attached to said bottom portion of said pivot rod;

an open faced adjustable utensil clamp having jaws movable over a range of separation distances;

a utensil sleeve with a sleeve diameter having an adjustment aperture angularly adjustably attached to said utensil clamp, whereby a utensil retained in said utensil holder can be angularly adjusted with respect to said utensil clamp;

an adjustment member adjustably extending through said adjustment aperture into said sleeve, whereby said utensil holder can retain any utensil having a diameter smaller than said sleeve diameter by compressing said utensil between said sleeve and said adjustment member;

whereby said pivot clamp is attachable to a pivot portion of an intermediate bar and said utensil clamp is attachable to a utensil portion of said intermediate bar to form a compass;

a detachable foot adapted to be retained on said pivot point; and vertically and diagonally outwardly extending wings attached to one of said jaws of one of said clamps.

13. A device according to claim 12. wherein said jaw having said wings is invertable.

* * * * *